US008292658B2

(12) United States Patent
Sullivan et al.

(10) Patent No.: US 8,292,658 B2
(45) Date of Patent: Oct. 23, 2012

(54) APPARATUS AND METHOD FOR CONNECTING EMERGENCY POWER

(75) Inventors: Marion King Sullivan, Amarillo, TX (US); William Dewey Sullivan, Jr., Georgetown, SC (US)

(73) Assignee: William Dewey Sullivan, Jr., Georgetown, SC (US)

( * ) Notice: Subject to any disclaimer, the term of this patent is extended or adjusted under 35 U.S.C. 154(b) by 57 days.

(21) Appl. No.: 13/041,738

(22) Filed: Mar. 7, 2011

(65) Prior Publication Data

US 2011/0269337 A1 Nov. 3, 2011

Related U.S. Application Data

(60) Provisional application No. 61/328,997, filed on Apr. 28, 2010.

(51) Int. Cl.
*H01R 33/945* (2006.01)

(52) U.S. Cl. ..... 439/517

(58) Field of Classification Search ..... 439/517, 439/146, 107, 508
See application file for complete search history.

(56) References Cited

U.S. PATENT DOCUMENTS

| | | | | |
|---|---|---|---|---|
| 4,258,968 | A | 3/1981 | Holt | |
| 4,944,692 | A * | 7/1990 | Allina | 439/517 |
| 5,315,475 | A * | 5/1994 | Scheidel et al. | 361/643 |
| 7,905,748 | B2 * | 3/2011 | Benke | 439/517 |
| 2009/0247016 | A1 * | 10/2009 | Benke | 439/628 |

* cited by examiner

*Primary Examiner* — Phuong Dinh

(57) ABSTRACT

A connection system for providing auxiliary electrical power to electrical loads of a building may include a meter box having one or more load receptacles connectable with the electrical loads of the building and one or more power grid receptacles connectable to a power grid and a connection unit with one or more load stabs configured for engagement with the load receptacles and for electrical interconnection with the auxiliary power source. The one or more load stabs may be positioned to be electrically isolated from the power grid receptacles.

9 Claims, 3 Drawing Sheets

APPARATUS AND METHOD FOR CONNECTING EMERGENCY POWER

RELATED APPLICATIONS

This application claims the benefit of U.S. Provisional Application No. 61/328,997 filed Apr. 28, 2010.

BACKGROUND OF THE INVENTION

The present invention generally relates to systems for connecting auxiliary power sources such as emergency electrical generators to provide distribution of electrical power within a building.

Typically, electrical power may be supplied to one or more buildings from a power grid operated by an electrical power supplier. Occasionally power delivery to a building may be temporarily interrupted because of storm damage or other accidental damage within the power grid. In such circumstances, building owners may elect to connect portable generators to their building's wiring system in order to maintain availability of electrical power. When such a generator connection is made, it is imperative to avoid back-feeding of power from the portable generator to the power grid.

In a typical residential building back-feed prevention may be provided with specially designed interlocking switching devices which may allow some portion, but not all, of the building's wiring system to be electrically energized.

As can be seen, there is a need for a system which permits connection of a generator to provide power for an entire wiring system of a building. Such a system must be capable of preventing back-feeding from the generator to the power grid.

SUMMARY OF THE INVENTION

In one aspect of the present invention, a connection system for providing auxiliary electrical power to electrical loads of a building through a meter box with load receptacles and power grid receptacles, the system may comprise a connection unit with a cast resin body configured in a shape of a meter that fits the meter box, the connection unit including load stabs partially embedded in the cast resin body and configured for engagement with the load receptacles and for electrical interconnection with the auxiliary power source, and the load stabs being positioned to be electrically isolated from the power grid receptacles.

In another aspect of the present invention, a connection unit for connecting an auxiliary power source to a wiring system of a building, the connection unit may comprise: a body formed of cast resin and configured to enclose a meter socket of a meter box of the building; load stabs configured to engage with load receptacles of the meter box; and auxiliary power attachment cables electrically interconnected with the load stabs so that the auxiliary power source is electrically interconnectable with the load receptacles of the meter box, the load stabs and the auxiliary power attachment cables being partially embedded in the cast resin of the body and held in position by the cast resin.

In still another aspect of the invention, a method for interconnecting an auxiliary power source with a wiring system of a building comprising the steps of: removing an electrical meter from a meter socket of a meter box of the building; connecting a first end of neutral wire to a neutral terminal of the meter box; passing a second end of the neutral wire through a connection unit; placing the connection unit into the meter socket so that load stabs of the connection unit engage with load receptacles of the meter box; connecting the auxiliary power source to load attachment cables attached to the load stabs, removing the connection unit when power is restored to power grid receptacles of the meter box; and coiling the neutral wire inside the meter box while leaving the neutral wire connected to the neutral terminal.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features.

Broadly, embodiments of the present invention generally provide a system for interconnecting an auxiliary power source such as a portable generator to a meter box of a building in a manner that precludes back-feeding of power from the generator to the power grid.

Figure 1:
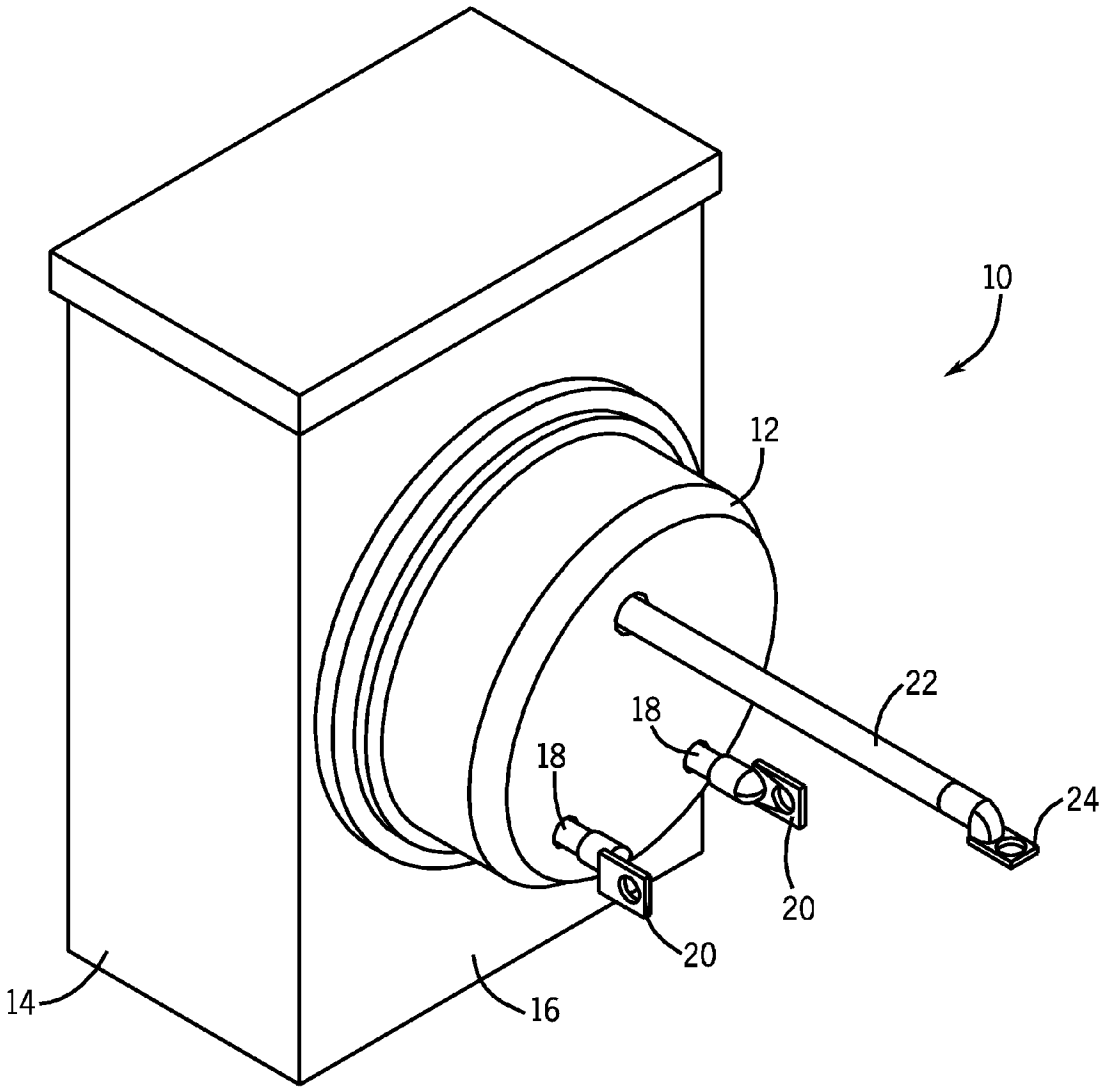
FIG. 1 is a perspective view of a connection system in accordance with an embodiment of the invention.
Figure 2:
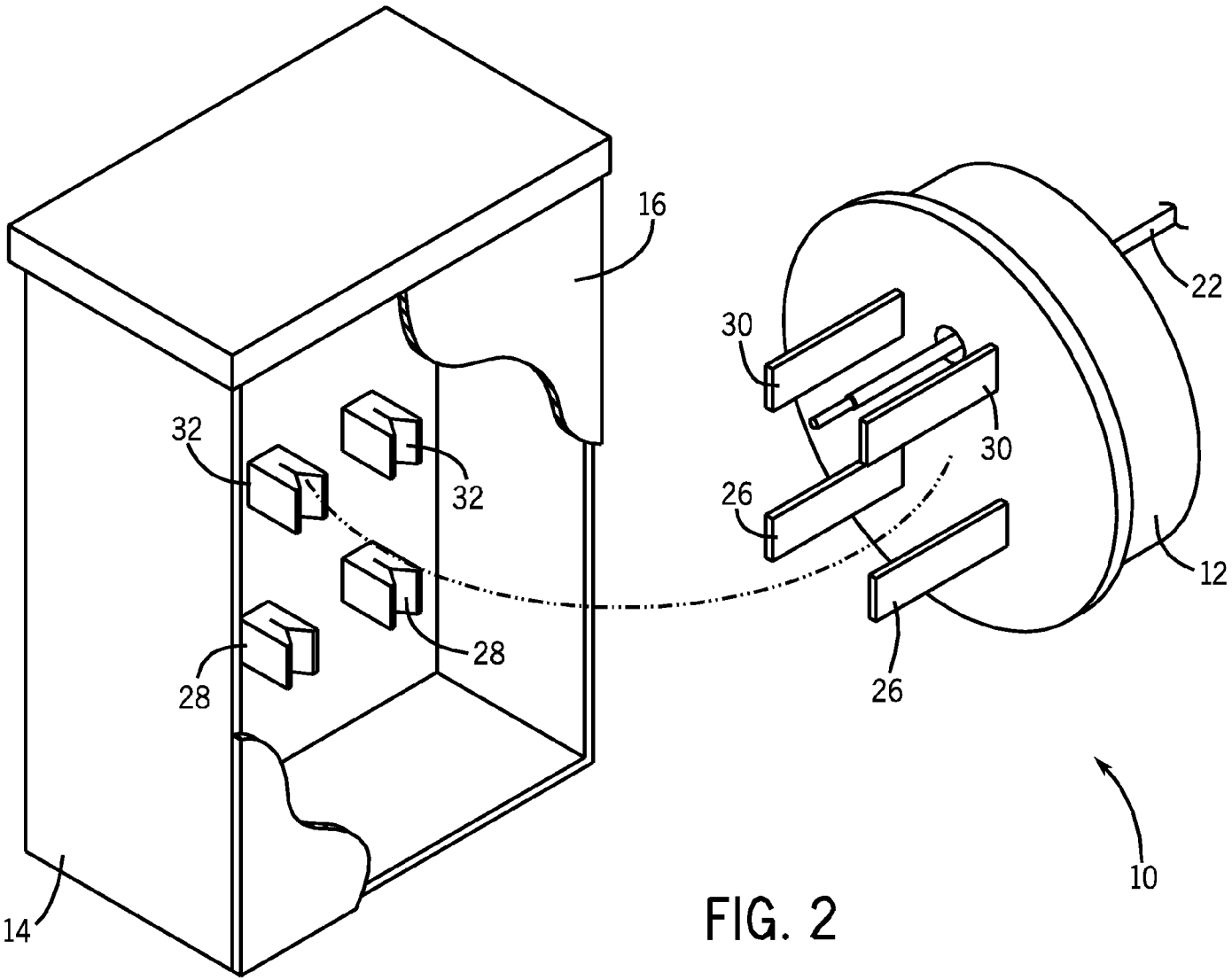
FIG. 2 is an exploded perspective view of the system of FIG. 1 in accordance with an embodiment of the invention.

Referring now to FIGS. 1 and 2, it may be seen that an exemplary embodiment of a generator connection unit 10 may comprise a connector body 12, load attachment cables 18 for an auxiliary power source (not shown), lugs 20 of cables 18, a neutral wire 22, a lug 24 of neutral wire 22, load stabs 26 and alignment stabs 30. The body 12 of the connection unit 10 may be configured in the same shape as a conventional electric meter (not shown).

In the event of a power failure from the power grid, an electric meter may be removed from a meter socket 11 of a meter box 14 and the connection unit 10 may be placed into the vacated meter box 14. As seen in FIG. 2, the load stabs 26 may be engageable with load receptacles 28 of the meter box 14. The alignment stabs 30 may be engageable with power grid receptacles 32 of the meter box 14. The neutral wire 22 may be connectable to a neutral terminal (not shown) in the meter box 14.

Figure 3:
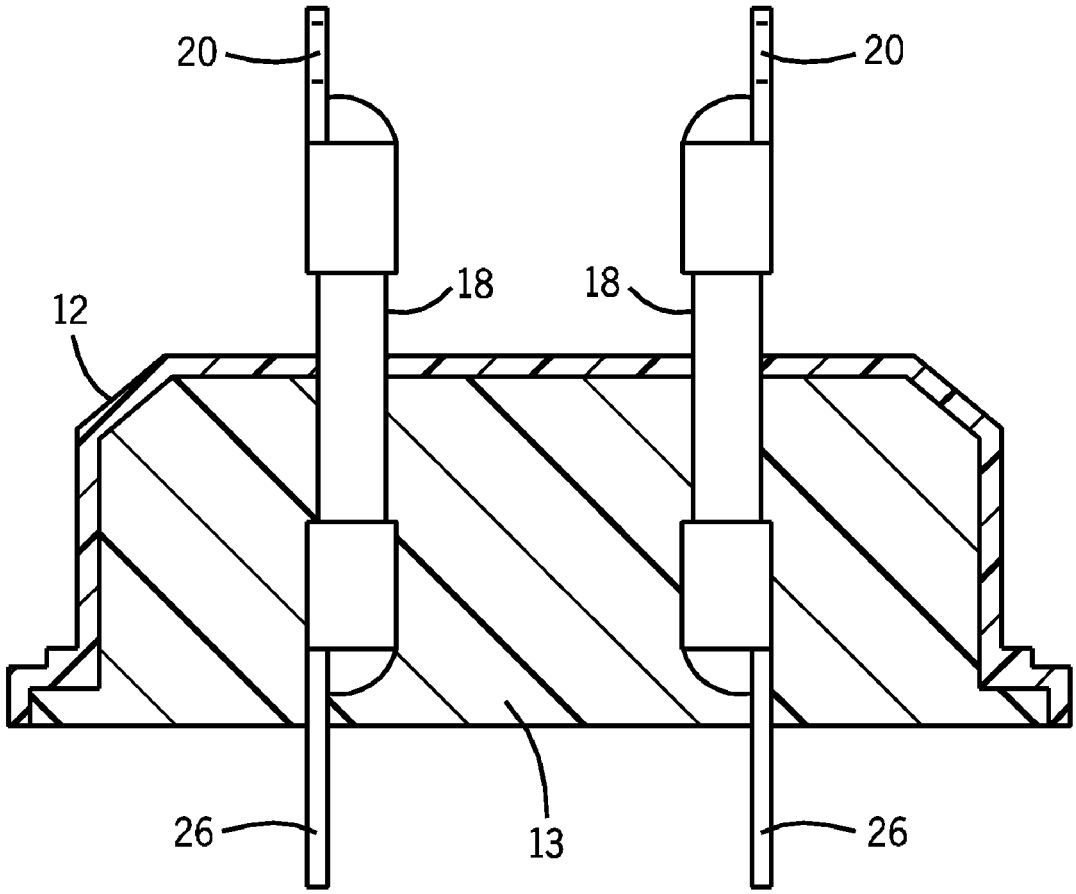
FIG. 3 is a cross sectional view of a connection unit in accordance with an embodiment of the invention.

Referring now to FIG. 3, it may be seen that the body 12 of the connection unit 10 may be constructed from a cast resin 13 (e.g., polyester, acrylic or epoxy). Each of the load stabs 26 may partially embedded in the cast resin 13 and may be completely supported by the cast resin 13. In an exemplary embodiment, the load stabs 26 may be lugs which may be crimp-connected to the load attachment cables 18. The load stabs 26 may be electrically isolated from one another. The alignment stabs 30 may be embedded and the cast resin and may be electrically isolated from one another. Additionally, the alignment tabs 30 may be electrically isolated from the load stabs 26.

It may be seen that the connection unit 10 may be constructed without use of fasteners to hold the load stabs 26 and alignment stabs 30 in their respective position. The load stabs 26 and alignment stabs 30 may be held securely in position by the cast resin 13 in which they may be embedded.

In an exemplary embodiment of the connection unit 10, the load attachment cables 18 may comprise 2/0 copper stranded shielded wire, the neutral wire 22 may comprise #5 shielded soft copper welding wire (flexible). The load stabs 26 and the lugs 20 and 24 may be UL listed crimped tinned copper lugs. In this exemplary configuration, the connection unit 10 may be employed to connect auxiliary power of up to 200 amps.

In a typical building wiring system, the load receptacles 28 may be electrically interconnected with a circuit breaker panel (not shown). Thus the load receptacles 28 may be connectable to all of the electrical loads of the building.

It can be seen that when the lugs 20 of the load attachment cables 18 are connected to an auxiliary power source such as a portable generator, power from that auxiliary source may be directed to any and/or all electrical loads in the building. It may also be seen that, since the alignment stabs 30 may be electrically isolated from the load stabs 26, there may be no electrical back-feed from the auxiliary power source to the power grid receptacles 32.

The connection unit may be employed to connect a conventional 240 volt auxiliary power source by connecting the source to both of the load attachment cables 18. Alternatively, the connection unit 10 may be employed to connect a 120 volt auxiliary power source to the building wiring by connecting the source to only one of the load attachment cables 18. In the case of a single load cable connection for a typical residential building, only about 50% of the electrical loads may be connectable to the auxiliary power source.

In an exemplary employment of the connection unit 10 the following steps may be performed. An electrical meter may be removed from a meter socket of a meter box of the building. A first end of neutral wire 22 may be connected to a neutral terminal of the meter box 14. A second end of the neutral wire 22 may be passed through the connection unit 10. The connection unit 10 may be placed into the meter socket 11 so that load stabs 26 of the connection unit 10 engage with load receptacles 26 of the meter box 14. The auxiliary power source may be connected to load attachment cable 18 attached to the load stabs 26. The connection unit 10 may be removed when power is restored to power grid receptacles 32 of the meter box 14. The neutral wire 22 may be coiled inside the meter box 14 while leaving the neutral wire 22 connected to the neutral terminal so that subsequent use of the connection unit 10 may be made without a need for re-connecting the neutral wire.

It should be understood, of course, that the foregoing relates to exemplary embodiments of the invention and that modifications may be made without departing from the spirit and scope of the invention as set forth in the following claims.

What is claimed is:

1. A connection system for providing auxiliary electrical power to electrical loads of a building through a meter box with load receptacles and power grid receptacles, the system comprising:

a connection unit with a cast resin body configured in a shape of a meter that fits the meter box, the connection unit including load stabs partially embedded in the cast resin body and configured for engagement with the load receptacles and for electrical interconnection with the auxiliary power source, the load stabs being positioned to be electrically isolated from the power grid receptacles, further comprising: load-attachment cables attached to the load stabs with lug-crimp connections, the lug-crimp connections and first portions of the load-attachment cables being embedded in the cast resin body, second portions of the load-attachment cables extending out of the cast resin body and being accessible for connection to an auxiliary power source when the connection unit is installed in the meter box.

2. The connection system of claim 1 wherein the load-attachment cables comprise 2/0 copper stranded wire rated for 200 amp service.

3. The connection system of claim 1 further comprising alignment stabs configured for engagement with the power grid receptacles.

4. The connection system of claim 3 wherein the alignment stabs are partially embedded in the cast resin body and are electrically isolated from the load stabs.

5. The connection system of claim 1 further comprising:

a neutral cable with a lug crimped onto one end, the body having a hole large enough to allow the lug to pass through the hole so that the neutral cable can remain attached to a neutral terminal of the meter box when the connection unit is removed from the meter box upon restoration of power to the power grid receptacles.

6. A connection unit for connecting an auxiliary power source to a wiring system of a building, the connection unit comprising:

a body formed of cast resin and configured to enclose a meter socket of a meter box of the building;

load stabs configured to engage with load receptacles of the meter box; and auxiliary power attachment cables electrically interconnected with the load stabs so that the auxiliary power source is electrically interconnectable with the load receptacles of the meter box, the load stabs and the auxiliary power attachment cables being partially embedded in the cast resin of the body and held in position by the cast resin, further comprising: load-attachment cables attached to the load stabs with lug-crimp connections, the lug-crimp connections and first portions of the load-attachment cables being embedded in the cast resin body, second portions of the load-attachment cables extending out of the cast resin body and being accessible for connection to an auxiliary power source when the connection unit is installed in the meter box.

7. The connection unit of claim 6 further comprising alignment stabs partially embedded in the cast resin of the body and configured to engage with power grid receptacles of the meter box, the alignment tabs being electrically isolated from the load stabs.

8. The connection unit of claim 6 further comprising a neutral wire passing through a hole in the connection unit so that a neutral connection can be made between the auxiliary power source and a neutral terminal in the meter box.

9. A method for interconnecting an auxiliary power source with a wiring system of a building comprising the steps of:

removing an electrical meter from a meter socket of a meter box of the building;

connecting a first end of neutral wire to a neutral terminal of the meter box;

passing a second end of the neutral wire through a connection unit;

placing the connection unit into the meter socket so that load stabs of the connection unit engage with load receptacles of the meter box;

connecting the auxiliary power source to load attachment cables attached to the load stabs, removing the connection unit when power is restored to power grid receptacles of the meter box; and coiling the neutral wire inside the meter box while leaving the neutral wire connected to the neutral terminal, further comprising: load-attachment cables attached to the load stabs with lug-crimp connections, the lug-crimp connections and first portions of the load-attachment cables being embedded in the cast resin body, second portions of the load-attachment cables extending out of the cast resin body and being accessible for connection to an auxiliary power source when the connection unit is installed in the meter box.

* * * * *